US010450696B2

(12) United States Patent
Van Leeuwen et al.

(10) Patent No.: US 10,450,696 B2
(45) Date of Patent: Oct. 22, 2019

(54) FLOATING LINEAR TENSION MEMBER COMPRISING MULTIPLE FIBERS

(71) Applicant: TEIJIN ARAMID B.V., Arnhem (NL)

(72) Inventors: Mattheus Van Leeuwen, Apeldoorn (NL); Huibert Kwint, Veenendaal (NL); Stephanus Willemsen, Rheden (NL)

(73) Assignee: TEIJIN ARAMID B.V., Arnhem (NL)

( * ) Notice: Subject to any disclaimer, the term of this patent is extended or adjusted under 35 U.S.C. 154(b) by 0 days.

(21) Appl. No.: 15/034,193

(22) PCT Filed: Nov. 6, 2014

(86) PCT No.: PCT/EP2014/073891

§ 371 (c)(1),
(2) Date: May 4, 2016

(87) PCT Pub. No.: WO2015/067684

PCT Pub. Date: May 14, 2015

(65) Prior Publication Data

US 2016/0281295 A1 Sep. 29, 2016

(30) Foreign Application Priority Data

Nov. 7, 2013 (EP) ..... 13191949

(51) Int. Cl.
*D07B 3/00* (2006.01)
*D06M 23/08* (2006.01)
(Continued)

(52) U.S. Cl.
CPC ..... *D06M 23/08* (2013.01); *D06M 23/12* (2013.01); *D07B 1/025* (2013.01); *D07B 1/20* (2013.01);
(Continued)

(58) Field of Classification Search
CPC ... D07B 3/00; D07B 5/00; D07B 1/02; D07B 1/025; D07B 1/14; D07B 1/141;
(Continued)

(56) References Cited

U.S. PATENT DOCUMENTS 3,578,763 A 5/1971 Platou
6,407,197 B1 6/2002 Van Den Berg et al.
(Continued)

FOREIGN PATENT DOCUMENTS

EP 0136727 A1 4/1985
EP 1405865 A1 4/2004
(Continued)

OTHER PUBLICATIONS

Twaron® Brochure, page visited Jun. 20, 2017.*
(Continued)

*Primary Examiner* — Matthew D Matzek
(74) *Attorney, Agent, or Firm* — Oliff PLC

(57) ABSTRACT

Linear tension member having multiple fibers and at least 0.1 wt % of solid hydrophobic organic nanoparticles with a mean diameter of 10-300 nm and a standard deviation σ of at least 10% of the mean value, which linear tension member has a linear mass density of at least 10.000 dtex and has at least 80 wt % of fibers having a mass density higher than 1 g/cm$^3$. The disclosure also pertains to the use of such particles for making a linear tension member buoyant and to a process to manufacture a floating linear tension member.

14 Claims, 1 Drawing Sheet

(51) Int. Cl.
*D07B 1/20* (2006.01)
*D06M 23/12* (2006.01)
*D07B 1/02* (2006.01)

(52) U.S. Cl.
CPC ..... *D07B 2205/205* (2013.01); *D07B 2205/2042* (2013.01); *D07B 2205/3003* (2013.01); *D07B 2205/3007* (2013.01); *D07B 2501/2061* (2013.01)

(58) Field of Classification Search
CPC ..... D07B 2201/00; D07B 2201/10; D07B 2201/104; D06M 23/08
USPC ..... 428/357, 364, 372, 402; 427/180; 264/176.1, 211.14; 57/200, 243, 258
See application file for complete search history.

(56) References Cited

U.S. PATENT DOCUMENTS 6,830,657 B1 12/2004 Betremieux et al.
2005/0036750 A1* 2/2005 Triplett ..... G02B 6/4495 385/100
2009/0253828 A1 10/2009 Van Den Abbeele
2012/0238165 A1* 9/2012 Akker ..... C09D 151/00 442/83
2012/0255430 A1* 10/2012 Bovenschen ..... F41H 5/0485 89/36.02

FOREIGN PATENT DOCUMENTS

KR 20120058837 A 6/2012
WO 2004/031249 A1 4/2004
WO 2007/014635 A2 2/2007
WO 2008014903 A1 2/2008
WO 2011/069941 A1 6/2011

OTHER PUBLICATIONS

Feb. 5, 2015 Written Opinion issued in International Application No. PCT/EP2014/073891.
Feb. 5, 2015 International Search Report issued in International Patent Application No. PCT/EP2014/073891.

* cited by examiner

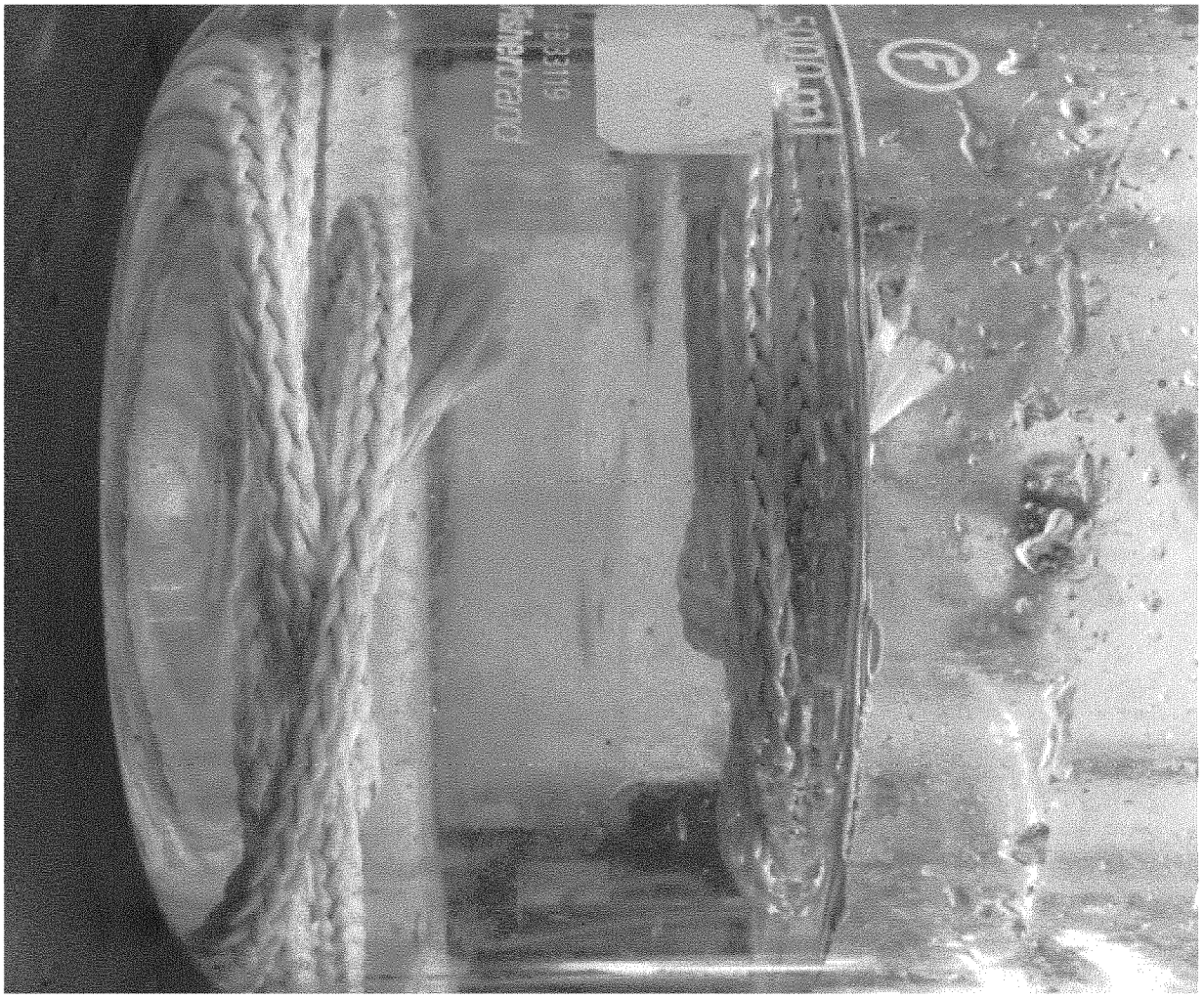
500 ml
Fisherbrand

FLOATING LINEAR TENSION MEMBER COMPRISING MULTIPLE FIBERS

BACKGROUND

This disclosure pertains to a linear tension member comprising multiple fibers which linear tension member floats in aqueous liquids.

Linear tension members are applied for many different purposes. In some circumstances, it is advantageous if the linear tension member can float in water. For example, ropes that are used in marine environments and fall accidentally into the water are easily seen, can be easily retrieved if they float and are prevented from contact with underwater elements, such as rotating parts.

Linear tension members made from materials with a higher density than water do not float but instead sink in water. Several fibers commonly used to produce linear tension members have a higher density than water, e.g. aramids have a density of ca. 1.4 g/cm$^3$, polyester of ca. 1.4 g/cm$^3$, polyamide of ca. 1.15 g/cm$^3$.

Linear tension members made from these fibers do not float in water.

KR20120058837 describes a fiber, e.g., made from aramid, which can float in distilled water. The fiber is treated with a finish of silicone oil, which preferably comprises at least 99% of silicone oil.

However, silicone oil has several disadvantages when used. Silicone has a negative impact on adhesion or bonding with other material. The friction coefficient of silicone is low which hinders interconnection of fibers during manufacture, use and transport. A linear tension member coated with silicone can therefore only with difficulties be coated with another material. Also, silicone oil has a low biodegradability and is therefore less suited for application in marine environments. Another disadvantage of silicone is its high price.

U.S. Pat. No. 3,578,763 pertains to floatable cords for use in fishing nets and the like comprising a core of continuous filaments, a braided sleeve and particles of expanded plastic material between the sleeve and the core, e.g., polystyrene particles. The disadvantage of these cords is that the cord diameter is significantly increased by the expanded particles and the cord construction always requires a sleeve to hold the expanded particles in place. Also the manufacture of such cords is relatively complicated and requires multiple steps.

BRIEF SUMMARY

The present disclosure provides linear tension members which overcome these limitations of the prior art.

The present inventors have now found that a linear tension member comprising multiple fibers and at least 0.1 wt % solid hydrophobic organic nanoparticles with a mean diameter of 10-300 nm and a standard deviation σ of at least 10% of the mean diameter, which linear tension member has a linear mass density of at least 10,000 dtex and comprises at least 80 wt % of fibers having a density higher than 1 g/cm$^3$ floats in water and exhibits advantageous properties.

The nanoparticles preferably are present in the linear tension member in an amount of 0.1 to 20 wt %, preferably 0.5-10 wt %, more preferably 1-9 wt %, even more preferably 2-8 wt % based on the weight of the fibers.

BRIEF DESCRIPTION OF THE DRAWING

FIG. 1 shows the aramid rope according to the description floating on the water surface, while the same aramid rope not comprising hydrophobic nanoparticles sinks to the bottom.

DETAILED DESCRIPTION

For the purpose of this disclosure, linear tension members are defined as elongated objects of which one dimension is much larger than the other two dimensions, which have a linear mass density of at least 10,000 dtex. The linear tension member described herein comprises multiple fibers being in close contact which each other by twisting, spiraling, braiding, entangling, knitting or any combination of these methods.

For example, twisted and parallel laid fibers can be combined in one linear tension member. The linear tension member described herein with tightly combined fibers generally has a higher mass density than a loosely combined bundle of fibers. The linear mass density of the linear tension member may be determined according to ASTM-D 1907. The linear tension member is especially fit to be subjected to axial tensile forces and therefore functions as load-bearing member.

Non-limiting examples of linear tension members are ropes, lines, tethers, mooring lines, tow lines and cables.

Surprisingly, the linear tension member described herein, even though comprising fibers that are densified (as is desired in many linear tension members), stays afloat as a linear tension member that is a bundle of the same loosely combined fibers that are also treated with the same finish and that have a lower mass density than the linear tension member described herein. It would be expected that the application of solid hydrophobic organic nanoparticles is less effective for densified linear tension member with a higher mass density, which would therefore show lesser floating or for a shorter period.

Furthermore, the advantage of the disclosure is the small particle size of the solid hydrophobic organic nanoparticles, which does not increase the diameter of the fibers, and thus the diameter of the linear tension member. Also, the linear tension member of the disclosure may be produced simply by combining fibers which are treated with the solid hydrophobic organic nanoparticles as described herein. No separate layers have to be added to the linear tension member to achieve the floating effect.

The linear tension member described herein generally has a diameter between 3 and 300 mm, preferably the diameter is between 10 and 250 mm, more preferably between 20 and 100 mm and even more preferably between 40 and 80 mm.

The linear tension member can have a variety of cross-sections, e.g. circular, round and elliptic/oblong. Because a linear tension member comprises multiple elongate elements, it is never perfectly circular, but rather has a multi-faceted cross-section when closely observed. However, such forms are included within the terms round and elliptic or oblong.

The cross section of the linear tension member can change during use, meaning that the cross-section of a tensioned linear tension member shows a flattened, oval or even an almost rectangular form. In the case of a linear tension member with an oblong cross-section, the diameter refers to an effective diameter. The effective diameter of a linear tension member with a non-round cross-section refers to the diameter of a round linear tension member of the same mass per length as the non-round linear tension member.

The linear tension member has a linear mass density of at least 10,000 dtex and even more preferably at least 25.000 dtex. In general, a maximum linear mass density of 1000 Mtex can be stated. Depending on the use of the linear tension members, different linear mass densities are usually chosen. The linear tension members can e.g., have a linear mass density higher than 0.3 Mtex, preferably higher than 0.5 Mtex and up to 10 Mtex, preferably 5 Mtex. Such linear mass densities can be used for flowlines. However, this disclosure also includes linear tension members with a linear density of larger than 1 Mtex and up to 50, 100, 250, 500 or even 1000 Mtex. Such high linear density members are e.g., used for mooring lines.

A linear tension member can be obtained by any method known to the person skilled in the art, including, but not limited to, twisting and braiding and any combination thereof. For example, 2000 yarns of 1680 dtex each can be combined to result in a 33 Mtex linear tension member with a diameter of 20 mm.

In another rope, roughly 12000 yarns of 1680 dtex are combined to result in a rope of 200 Mtex with a diameter of 50 mm.

In a preferred embodiment, the linear tension member comprises fibers of a low titer, which means fibers with a low linear mass density per filament. For example, fibers with a linear mass density of 0.5-5 dpf (denier per filament) are suitable, preferably fibers with a linear density of less than 4 dpf, more preferably with a linear density of less than 3 or less than 2 dpf are chosen.

The linear tension member comprises multiple fibers.

Multiple fibers can be combined to result in a yarn e.g., in continuous yarn, a long continuous bundle of fibers. Within the context of the present specification, the term fiber encompasses multifilament fibers, but also tapes made from multifilament fibers.

A combination of fibers or yarns made thereof forms the linear tension member.

Yarns can be combined by a large variety of methods to result in a large variety of linear tension members with regard to linear mass density, diameter and integration of the yarns. For example, at least 2 yarns can be twisted together to obtain a strand. Such a strand can be a linear tension member.

However, it is also possible to take a number of strands and combine them to a larger linear tension member. Yarns and strands of yarns can be combined by braiding, twisting, beading, stranding or they can be laid in parallel or any combination thereof.

In a linear tension member the fibers, yarns and/or strands thereof are generally arranged in lengthwise direction.

In one embodiment, for at least some of the fibers or yarns, the distance of fibers or yarns to a central longitudinal axis within the linear tension members varies over the length of the linear tension member. This means that at least some of the fibers or yarns are arranged to show a repeating oscillation pattern. Generally, the fiber or yarn in such a linear tension member has a helix angle of more than 2°.

In another embodiment, the fibers, yarns and/or strands of the linear tension member are combined by laying at least two yarns or strands in parallel and surrounding them by a sleeve, wrap or polymeric coating to keep the individual yarns or strands tightly together, and to protect the linear tension member. Generally, if arranged in parallel, the yarns or strands have a helix angle of 2° or less. Such an arrangement results in a unidirectional (UD) linear tension member.

Independently of the way of combining the fibers of the linear tension member, a mantle can be used to protect the linear tension member from particle ingress, e.g., from sand particles. The mantle, possibly in form of a sleeve, wrap or coating can cover the whole length of the linear tension member, only parts of it or e.g., only the splice site. At splice sites, the ends of two linear tension members are combined to result in one, longer linear tension member.

A (partial) mantle can be applied to all linear tension members described herein.

It is also possible that parallel laid yarns or strands and strands that comprise fibers and/or yarns with a helix angle of more than 2° are combined to one linear tension member.

The diameter of the final linear tension member can vary. In one embodiment, the linear tension member has a diameter of at least 5 mm, preferably at least 8 mm, more preferably at least 10 mm and even more preferably at least 20 mm. The chosen diameter depends on the use of the linear tension member. In general, linear tension members can be up to 500 mm in diameter, e.g., when used as mooring lines.

The fibers can be made from various materials. This disclosure is directed to fibers that have a density of higher than 1 g/cm$^3$. The density of fibers can be determined using ASTM-D3800 (determination at 20° C. according to ISO139). The density of the fiber can differ from the density of the material or polymer of which a fiber is made.

Examples of suitable materials for these fibers are various natural and synthetic fibers, as e.g., mineral fibers and fibers comprising aramid, polyester, liquid crystal (co)polyester, polybenzazole, polyamide, poly(vinyl alcohol), polyacrylonitrile, graphite, carbon, rigid rod polymer fibers, glass, and blends thereof. The linear tension members according to the described herein can comprise fibers made from one type of material, but also fibers made from different materials.

It also within the scope of this disclosure to combine fibers made from a material with a lower density than 1 g/cm$^3$ with fibers made from a material with a higher mass density. However, in such an embodiment, the average density of the fibers of the linear tension member is above 1 g/cm$^3$. For example, polyethylene fibers can be combined with aramid fibers.

In the context of the present specification, aramid refers to an aromatic polyamide that is a condensation polymer of aromatic diamine and aromatic dicarboxylic acid halide. Aramids may exist in the meta- and para-form, both of which may be used in the present disclosure. The use of aramid wherein at least 85% of the bonds between the aromatic moieties are para-aramid bonds is considered preferred. As typical members of this group are mentioned poly(paraphenylene terephthalamide), poly(4,4'-benzanilide terephthalamide), poly(paraphenylene-4,4'-biphenylenedicarboxylic acid amide) and poly (paraphenylene-2,6-naphthalenedicarboxylic acid amide or copoly(para-phenylene/3,4'-dioxyphenylene terephthalamide). The use of aramid wherein at least 90%, more in particular at least 95%, of the bonds between the aromatic moieties are para-aramid bonds is considered preferred. The use of poly(paraphenylene terephthalamide), also indicated as PPTA is particularly preferred.

Polyesters are polymers synthesized from dicarboxylic acid or its ester-forming derivative and a diol or its ester-forming derivative.

Examples of polyesters include, polyethylene terephthalate, polybutylene terephthalate, polycyclohexanedimethylene terephthalate, polytrimethylene terephthalate (a.k.a., polypropylene terephthalate), polyethylene naphthalate and polyethylene-1,2-bis(2-chlorophenoxy)ethane-4,4'-dicarboxylate.

Liquid crystal polyester (LCP) is preferably a polyester that exhibits mesomorphism in a molten state, and is melted at a temperature of 450° C. or lower. The liquid crystal polyester is a liquid crystal polyester amide, a liquid crystal polyester ether, a liquid crystal polyester carbonate, or a liquid crystal polyester imide. The liquid crystal polyester is preferably a whole aromatic liquid crystal polyester in which only an aromatic compound is used as a raw monomer. Typical examples of the liquid crystal polyester include (I) a liquid crystal polyester obtained by polymerizing (polycondensing) an aromatic hydroxycarboxylic acid, with an aromatic dicarboxylic acid, and at least one kind of a compound selected from the group consisting of an aromatic diol, an aromatic hydroxyamine and an aromatic diamine; (II) a liquid crystal polyester obtained by polymerizing plural kinds of aromatic hydroxycarboxylic acids; (III) a liquid crystal polyester obtained by polymerizing an aromatic dicarboxylic acid with at least one kind of a compound selected from the group consisting of an aromatic diol, an aromatic hydroxyamine and an aromatic diamine; and (IV) a liquid crystal polyester obtained by polymerizing a polyester such as polyethylene terephthalate with an aromatic hydroxycarboxylic acid. Herein, a part or all of an aromatic hydroxycarboxylic acid, an aromatic dicarboxylic acid, an aromatic diol, an aromatic hydroxyamine and an aromatic diamine may be changed, respectively independently, to a polymerizable derivative thereof.

For purposes of this application, the term polybenzazole includes polybenzoxazole (PBO) homopolymers, polybenzothiazole (PBT) homopolymers and random, sequential and block copolymers of PBO and/or PBT.

Polyamide as used in this application refers to any of the various generally linear, aliphatic polycarbonamide homopolymers and copolymers which are typically melt-spinnable and, when drawn, yield fibers having properties suitable for industrial applications. For example, poly(hexamethylene adipamide) (6,6 nylon) and poly(ε-caproamide) (6 nylon), poly(tetramethylene adipamide) (4,6 nylon) are typically-used polyamides for industrial fibers. The disclosure is also applicable to copolymers and mixtures of polyamides.

The linear tension members according to this disclosure float on water and aqueous solutions. The linear tension members described herein float in pure water, but also in water with a salt content of up to 10 wt % which can occur in surface water, and in water or salt water comprising traces of contaminants, as e.g., oil.

Floating for the purpose of this disclosure, this means that the upward force of buoyancy of the linear tension member according to this disclosure is at least equal to the downward force of gravity even though the mass density of the fibers is higher than the density of the water.

A linear tension member made of the same fibers, of the same construction and not comprising the nanoparticles will sink. Advantageously, the linear tension member described herein (with tightly combined fibers) stays afloat as long as a bundle of loosely combined fibers even though the linear tension member described herein has a higher mass density than loosely combined fibers.

The linear tension member comprises solid hydrophobic organic nanoparticles with a mean diameter of 10-300 nm and a standard deviation σ of at least 10% of the mean diameter. The solid hydrophobic organic nanoparticles are not hollow, i.e., bulky.

The particles used herein have a mean diameter of 10-300 nm, preferably 20-200 nm, and more preferably 25-100 nm. A narrow nanoparticle size distribution is not advantageous in this case. It was found that mixtures of particles of different diameters significantly contribute to the hydrophobicity and floating capacity. If the particles have different diameters, water molecules have more difficulty to attach to the particle, which leads to increased hydrophobicity. For this reason is it advantageous to use nanoparticles of which the diameters vary with a standard deviation σ of at least 10% of the mean diameter, preferably at least 20%, and more preferably at least 30%. Thus, as well nanoparticles having smaller diameters, nanoparticles having larger diameters than the mean diameter of all nanoparticles are contained in the mixture, which is preferred.

This effect can be measured as a better than 90° contact angle and is called super-hydrophobicity. The contact angle is the angle at which a liquid interface (e.g. water) meets the solid surface of the nanoparticle. Contact angles are preferably as high as possible and contact angles better than 100°, better than 115° or even better than 135° can be attained. A large variance of the nanoparticle diameter distribution helps in obtaining large contact angles.

The nanoparticles can in principle have any shape, but spherical, elliptical, and rod shaped particles are preferred for having the smallest contact areas with water molecules. The particles should retain their shape under the conditions in which the linear tension member is used. They should not dissolve, melt or change their shape.

In one embodiment, the nanoparticles comprise a copolymer of vinyl aromatic monomer and maleimide monomer with a glass transition temperature Tg of between 120 and 220° C.

In a preferred embodiment, the hydrophobic particles are core-shell particles, meaning that the core and shell of the particle are formed from different materials. The core of the core-shell particle can comprise a wax, paraffin or oil.

Preferably, core-shell particles with a shell that comprises a copolymer of vinyl aromatic monomer and maleimide monomer with a glass transition temperature of between 120 and 220° C. are used in the linear tension member, particularly a shell that comprises poly(styrene-co-maleimide).

Core-shell particles are known. WO2008/014903 discloses particle in the shape of an encapsulated droplet comprising a core material and a shell material surrounding the core material, where the shell material contains a copolymer of styrene and maleic anhydride derivatives. Poly (styrene-co-maleimide) is a polymer which has been used to confer hydrophobic and anti-wicking properties. In U.S. Pat. No. 6,407,197 and EP 1405865, the aqueous dispersion has been described of a polymer of vinyl aromatic monomer and maleimide monomer units, obtained by the imidization of a starting polymer which contains vinyl aromatic monomer and maleic anhydride monomer units. Typically, poly(styrene-co-maleic anhydride) (SMA) is a suitable starting polymer for obtaining poly(styrene-co-maleimide) (SMI) upon imidization. SMA can be converted to SMI with, for instance, ammonia. The imidization of SMA, and more generally, of copolymers of vinyl aromatic monomer and maleic anhydride monomer, is a known process and applications with paper and board have been described in various patent applications, such as U.S. Pat. Nos. 6,407,197, 6,830,657, WO2004/031249 and US2009/0253828. In WO 2007/014635, pigment particles with SMI at its surface have been described as a coating composition for paper. Suitable SMI-polymers have a glass transition temperature Tg of between 120 and 220° C., more preferably between 150 and 210° C.

The glass transition temperature Tg is determined by DSC (Differential Scanning Ccalorimetry), e.g. using a TA instruments Q2000 calorimeter (Advanced Zero Technologies) and a 5 mg sample. Two heating and cooling cycles are performed over a range of −30° C. to 250° C. at a heating and cooling rate of 10° C./min. The measurements of the second heating cycle are used for determining Tg. For the interpretation of the results, the DSC software "TA universal analysis 2000" is used.

In WO2011/069941, similar core-shell particles are used for coating a yarn or fabric to inhibit wicking in the yarn or fabric.

Core-shell particles with SMI-shell are known and commercially available as NanoTope® 26 PO30, which consists of SMI core-shell particles and has 70 parts palm oil as the core and 30 parts SMI as the shell. Another commercially available product is NanoTope® 26 WA30, which consists of SMI core-shell particles wherein 70 parts paraffin wax make the core and 30 parts SMI make the shell. The SMI layer is very thin (in the nanometer-range) and the aliphatic chains of the paraffin are capable of penetrating the SMI-outer-layer thereby contributing to the hydrophobicity of the particles. The core is hydrophobic, and can in principle be any oil, paraffin or wax, or a mixture thereof. Paraffin includes alkanes, polyolefins, and terpenes. Oils include vegetable oils, vaseline oils, and paraffin waxes.

Suitable nanoparticles are hydrophobic and the additional nano-aspect (i.e. the different sizes of the particles) creates super hydrophobic properties for fibers supplied with the nanoparticles.

This has in particular been shown for SMI-based core-shell particles. An additional advantage of particles wherein the core is of a material such as palm oil or Castor oil, is the fact that these oils are renewable and bio-degradable, which is advantageous for environmental reasons.

None of the references describing core-shell particles describes that particle-coated fibers or yarns can be used to prepare linear tension members that float in aqueous liquids. As pointed out before, it is expected that the floating effect is improved with an increase of the linear mass density of the linear tension member.

Without wishing to be bound by any theory, it is likely that the presence the core-shell particles described herein traps air in the linear tension members that is present in and between the fibers of the linear tension member. That means air present between the filaments of the fibers, between the fibers of yarns and between the yarns and strands. Because of this, the effective density of the linear tension member described herein in water is equal or lower than the density of the liquid even though the fibers used in present disclosure have a higher density.

Preferably, the disclosure pertains to a linear tension member wherein the solid hydrophobic organic nanoparticles are present on the surface of at least some of the fibers or yarns of the linear tension member.

In one embodiment, the solid hydrophobic organic nanoparticles are present on the surface of all the fibers or yarns of the linear tension member. The solid hydrophobic organic nanoparticles can be applied in various ways known to the skilled person. For example, the nanoparticles can be applied as a coating or finish. The nanoparticles can be applied to the fibers, the yarns, strands and/or the complete linear tension member. Preferably, the coating is supplied to each of the yarns or strands of the linear tension member.

The various embodiments described above can be combined in one linear tension member as the person skilled in the art sees fit.

The disclosure also pertains to the use of at least 0.1 wt % of solid hydrophobic organic nanoparticles with a mean diameter of 10-300 nm and a standard deviation σ of at least 10% of the mean diameter for making a linear tension member with a linear mass density of at least 10,000 dtex buoyant in aqueous liquids. Aqueous liquids include pure water, but also water with a salt content of up to 10 wt % which can occur in surface water, and water or salt water comprising traces of contaminants, as e.g. oil.

The various embodiments described for the linear tension member of the disclosure and any combination thereof apply also to the use of the solid hydrophobic organic nanoparticles for making a linear tension member buoyant.

Preferably, core-shell particles are used with a mean diameter of 10-300 nm and a standard deviation σ of at least 10% of the mean value, wherein the shell of the core-shell particle comprises a copolymer of vinyl aromatic monomer and maleimide monomer with a glass transition temperature Tg of between 120 and 220° C., in particular poly(styrene-co-maleimide), for making a linear tension member buoyant in aqueous liquids.

Furthermore, the disclosure also pertains to a process to make a buoyant linear tension member by combining multiple fibers of which at least one fiber is coated with solid hydrophobic organic nanoparticles with a mean diameter of 10-300 nm and a standard deviation σ of at least 10% of the mean value wherein the amount of said solid hydrophobic organic nanoparticles is at least 0.1 wt % based on the weight of the linear tension member. The various embodiments described for the linear tension member of the disclosure and combinations thereof apply also to the process to make a buoyant linear tension member. Preferably, the process employs core-shell particles, wherein the shell of the core-shell particle comprises a copolymer of vinyl aromatic monomer and maleimide monomer with a glass transition temperature Tg of between 120 and 220° C., in particular poly(styrene-co-maleimide)

During the process, the nanoparticles are brought into contact with the fibers, yarns, strands or the linear tension member by any commonly used application technique, e.g. in a bath or by kiss rolls or slit applicators. The particles can e.g., be in the form of a solution or dispersion. Typical process speeds are 10 to 700 m/min, more preferably 25 to 500 m/min. Typical amounts of the particles on the yarn or fabric are 0.1 to 20 wt %, preferably 0.5 to 10 wt %, even more preferably 1-5 wt %, based on the weight of the fibers of the linear tension member. The nanoparticles can be applied as a dispersion, e.g., as a coating of the surface of the fibers, yarns, strands and/or the linear tension member.

If a hydrophilic finish is present on the fibers or yarns, this is preferably first removed (e.g., by evaporation or washing) before applying the nanoparticles. Preferably, a hydrophobic finish is present on the fibers before applying the nanoparticles. A preferred hydrophobic finish is a diglyceride- or triglyceride-comprising finish. Such a finish is obtained by esterifying glycerol with saturated or unsaturated fatty acids with 6-20 carbon atoms. Fibers treated with such a finish can subsequently be coated with the nanoparticles.

Accordingly, in one embodiment, the linear tension member comprises multiple fibers, at least 0.1 wt % of solid hydrophobic organic nanoparticles and a hydrophobic finish.

In one embodiment, the linear tension member consists of multiple fibers, at least 0.1 wt % of solid hydrophobic organic nanoparticles and a hydrophobic finish.

In one embodiment, the linear tension member consists of multiple fibers and at least 0.1 wt % of solid hydrophobic organic nanoparticles.

The following examples and figures provide more detail, but are by no means limiting the scope of the disclosure.

Example 1

Floating Properties of Aramid Rope

Braided ropes of 5 mm diameter with a pitch length of 40 mm (regular braid) were prepared from 12 strands of Twaron 2200. Each strand comprised 8 1580f1000 yarns (twisted at 25 turns per meter on a Roblon Tornado 400, S25 or Z25 depending on the carrier rotation).

After twisting, the strands were braided into a rope with a Herzog SE 1-12-266 braiding machine (vertical braid direction). The 6 carriers that rotate clockwise carried the S25 bobbins inside the carrier and the 6 carriers that rotated counterclockwise carried the Z25 bobbins. The linear tension members had a linear density of ca. 155000 dtex, the fibers a density of 1.6 dpf. The ropes were prepared from unfinished Twaron 2200 yarns (control) or from unfinished Twaron 2200 yarns that were treated with an emulsion comprising NanoTope 26WA30 (60 wt % solids, supplier: TopChim) and Hymo90 (apolar finish oil, supplied by Goulston) at a weight ratio of 4:0.3. The emulsion of 3 wt % (solids based on weight of emulsion) was applied to the yarns by means of a slit applicator resulting in an amount of solids of ca. 3.9 wt % (corresponding to 3.5 wt % of nanoparticles) based on the yarn. Subsequently the yarns were dried in a hot air oven and wound on a bobbin.

The ropes were prepared and put into distilled water and sea water.

The rope prepared from untreated aramid yarn sunk immediately, while the rope prepared from treated yarns, thus a rope according to the disclosure, stayed afloat for more than 30 days in both distilled and sea water. See FIG. 1 for a photography showing the floating behavior of the linear tension member according to the disclosure.

Example 2

Floating Properties of Polyester Rope

Bundles of yarns comprising ca. 20 m of yarn were prepared from polyester yarn, more specifically polyethylene terephthalate (PET) fiber P900M (1100 T, 250 f) made by Teijin Fibers Ltd.

One bundle was prepared from untreated PET yarn (control).

Other bundles were prepared from the same PET yarn, but treated with an emulsion comprising NanoTope 26WA30 (60 wt % solids, supplier: TopChim) and Hymo90 (apolar finish oil, supplied by Goulston) at a weight ratio of 4:0.3. The emulsion was diluted in water to a solid content of 4.5-15 wt % (based on the weight of emulsion) rand applied to the yarn, resulting in a solids concentration on the yarn of 3-10 wt % (based on the weight of the yarn). The emulsion was applied with a slit applicator at a yarn speed of 25 m/min. Subsequently, the yarns were dried for ca. 72 seconds at 150 or 240° C. (see table 1).

All PET yarn bundles were dropped onto water. The floating behavior is shown in table 1.

TABLE 1

PET samples and floating behavior

| sample | Conc. of solids in emulsion (wt %) | drying temperature (° C.) | solids on yarn (wt %) | Nanoparticles on yarn (wt %) | Floating time |
|---|---|---|---|---|---|
| 1 | 4.5 | 150 | 3 | 2.7 | 6-7 hours |
| 2 | 7.5 | 150 | 5 | 4.45 | 7-24 hours |
| 3 | 15 | 150 | 10 | 8.9 | 7-24 hours |
| 4 | 15 | 240 | 10 | 8.9 | >40 days |
| 5 | 7.5 | 240 | 5 | 4.45 | 29-30 days |
| 6 | 4.5 | 240 | 3 | 2.7 | 1-2 hours |
| control | 0 | 240 | 0 | 0 | 2 minutes |

The control sample, a bundle of untreated PET yarn sunk very quickly. In contrast, the yarn coated with the nanoparticles stayed afloat for a period of hours or even up to more than one month (floating behavior not further determined), depending on the amount of emulsion on the yarn.

Example 3

Floating Properties of a Densified Linear Tension Member and a Bundle of Fibers An aramid rope was prepared as in example 1 from Twaron 2200 yarns treated with the same finish composition as in example 1 (sample). As a comparison sample, the same amount of finished yarns as for the sample was loosely combined in a bundle by fixating only the ends of the yarns by tying them together (control).

The mass density of the sample and the control were determined according to the "Operating instructions, Density determination kit for Excellence XP/XS precision balances of Mettler Toledo pursuant to the method for solids using water as auxiliary liquid.

The sample rope had a density of 0.29 g/ml, while the control had a density of 0.22 g/ml (the sample rope and the control comprise yarns are treated with the NanoTope composition). For at least 14 days, the floating behavior of the sample and the control in water was identical.

This experiment shows that the application of the solid hydrophobic organic nanoparticles lowers the effective density sufficiently, surprisingly even for a linear tension member with densified fibers.

The invention claimed is:

1. A floating linear tension member comprising multifilament yarns comprising multiple fibers and at least 0.1 wt % of solid hydrophobic organic nanoparticles based on a weight of the fibers of the linear tension member, wherein a mean diameter of the solid hydrophobic organic nanoparticles ranges from 10 to 300 nm, a standard deviation σ of the solid hydrophobic organic nanoparticles is at least 10% of the mean diameter, and the linear tension member is selected from ropes, lines, tethers, mooring lines, tow lines, or cables and has a linear mass density of at least 5 Mtex and a diameter of 20 mm to 500 mm, and comprises at least 80 wt % of fibers having a density higher than 1 g/cm$^3$, wherein the yarns are combined by braiding, twisting, beading, spiraling, entangling, knitting, stranding, or any combination thereof, to result in a densified linear tension member having a higher density than before the combination.

2. The floating linear tension member according to claim 1, wherein the fibers are selected from the group consisting of aramid, polyester, liquid crystal polyester, polybenzazole, polyamide, poly(vinyl alcohol), polyacrylonitrile, graphite, carbon, glass, mineral fibers and combinations thereof.

3. The floating linear tension member according to claim 1, wherein the solid hydrophobic organic nanoparticles are present on the surface of at least some of the fibers.

4. The floating linear tension member according to claim 1, wherein the solid hydrophobic organic nanoparticles have a mean diameter of 20 to 200 nm.

5. The floating linear tension member according to claim 1, wherein the standard deviation σ of the diameter of the nanoparticles is at least 20% of the mean diameter.

6. The floating linear tension member according to claim 1, wherein the solid hydrophobic organic nanoparticles comprise a copolymer of vinyl aromatic monomer and maleimide monomer with a glass transition temperature Tg ranging from 120 to 220° C.

7. The floating linear tension member according to claim 1, wherein the solid hydrophobic organic nanoparticles are core-shell particles.

8. The floating linear tension member according to claim 7, wherein the core of the core-shell particle is a hydrophobic material comprising a wax, paraffin or oil.

9. The floating linear tension member according to claim 7, wherein the shell of the core-shell particle comprises a copolymer of vinyl aromatic monomer and maleimide monomer.

10. A floating linear tension member comprising:

multifilament yarns comprising multiple fibers; and at least 0.1 wt % of solid hydrophobic organic nanoparticles based on a weight of the fibers of the linear tension member, wherein a mean diameter of the solid hydrophobic organic nanoparticles ranges from 10 to 300, nm, a standard deviation σ of solid hydrophobic organic nanoparticles is at least 10% of the mean diameter, a linear mass density of the linear tension member of at least 5 Mtex, the yarns are combined by braiding, twisting, beading, spiraling, entangling, knitting, stranding, or any combination thereof, to result in a densified linear tension member having a higher density than before the combination, and the linear tension member is selected from ropes, lines, tethers, mooring lines, tow lines, or cables and is buoyant in water and aqueous solutions, and has a diameter of 20 mm to 500 mm.

11. A process to manufacture a floating linear tension member selected from ropes, lines, tethers, mooring lines, tow lines, or cables having a linear mass density of at least 5 Mtex, and a diameter of 20 mm to 500 mm, the processes comprising:

combining multiple fibers or multifilament yarns, wherein at least one fiber or yarn of the combination is supplied with solid hydrophobic organic nanoparticles with a mean diameter of 10-300 nm and a standard deviation σ of at least 10% of the mean value, wherein the amount of solid hydrophobic organic nanoparticles is at least 0.1 wt % based on a weight of the linear tension member, wherein the yarns or fibers are combined by braiding, twisting, beading, spiraling, entangling, knitting, stranding, or any combination thereof, to result in a densified linear tension member having a higher density than before the combination.

12. The floating linear tension member according to claim 5, wherein the standard deviation σ of the diameter of the nanoparticles is at least 30% of the mean diameter.

13. The floating linear tension member according to claim 1, wherein a titer of the fibers of the linear tension member ranges from 0.5 to 5 denier per fiber.

14. The floating linear tension member according to claim 1, wherein the wt % of the solid hydrophobic organic nanoparticles ranges from 0.1 to 20 wt % based on the weight of the fibers of the linear tension member.

* * * * *